US012453890B2

(12) United States Patent
Defore

(10) Patent No.: US 12,453,890 B2
(45) Date of Patent: Oct. 28, 2025

(54) BALANCE BOARD

(71) Applicant: Seth R. Defore, Round O, SC (US)

(72) Inventor: Seth R. Defore, Round O, SC (US)

( * ) Notice: Subject to any disclaimer, the term of this patent is extended or adjusted under 35 U.S.C. 154(b) by 0 days.

(21) Appl. No.: 17/981,010

(22) Filed: Nov. 4, 2022

(65) Prior Publication Data

US 2023/0149773 A1 May 18, 2023

Related U.S. Application Data

(60) Provisional application No. 63/264,206, filed on Nov. 17, 2021.

(51) Int. Cl.
*A63B 22/16* (2006.01)
*A63B 22/18* (2006.01)

(52) U.S. Cl.
CPC ..... *A63B 22/16* (2013.01); *A63B 22/18* (2013.01); *A63B 2209/08* (2013.01); *A63B 2209/10* (2013.01)

(58) Field of Classification Search
CPC ..... A63B 22/16; A63B 22/18; A63B 2209/08; A63B 2209/10; A63B 69/0093; A63B 26/003; A63C 2203/46; A63C 17/012; A63C 17/015
See application file for complete search history.

(56) References Cited

U.S. PATENT DOCUMENTS

| | | | | |
|---|---|---|---|---|
| 3,895,794 | A * | 7/1975 | England | A63B 22/16 482/146 |
| 7,300,392 | B1 * | 11/2007 | Curran | A63B 22/18 482/146 |
| 7,357,767 | B2 * | 4/2008 | Tsai | A63B 21/0004 482/146 |
| 8,062,199 | B2 * | 11/2011 | Smith | A63B 69/0093 482/146 |
| 9,387,363 | B1 * | 7/2016 | Polinsky | A63B 26/003 |
| 2018/0133553 | A1 * | 5/2018 | Kramer | A63C 17/265 |
| 2022/0023734 | A1 * | 1/2022 | Wheeler | A63C 17/017 |

* cited by examiner

*Primary Examiner* — Andrew M Kobylarz
(74) *Attorney, Agent, or Firm* — Perilla Knox & Hildebrandt LLP

(57) ABSTRACT

Improved balance boards feature a combination of components that increases versatility and challenges with use. An elongated deck has a lower surface with a lengthwise recess configured to receive ground-contacting apparatus enabling a user to practice balancing on the board while standing on the upper surface of the deck. The ground-contacting apparatus may be balls of different sizes, rolling pins, or inserts with rollers, wheels, or non-rotating skateboard trucks. The inserts may have a peripheral edge that corresponds to the peripheral outline of the recess, and may be held in position using hook-and-loop fasteners, magnetic elements, or fasteners that extend through the insert and the deck.

17 Claims, 12 Drawing Sheets

BALANCE BOARD

REFERENCE TO RELATED APPLICATIONS

This application claims priority to and the benefit of U.S. Provisional Patent Application Ser. No. 63/264,206, filed. Nov. 17, 2021, the entire content of which is incorporated herein by reference.

FIELD OF THE INVENTION

The present invention relates to athletic equipment and, more particularly, to a balance board.

BACKGROUND OF THE INVENTION

Balance boards have been used in physical therapy and as strength building equipment for years. They help strengthen a user's lower limbs, upper limbs, and core. As balance boards affect and incorporate so many areas of the body, they have proven useful in a variety of treatments and training regiments that include improving balance, proprioceptive training, and the rehabilitation of muscles.

Current balance boards, however, operate along a single axis, making them easy to master. Thus, they quickly become obsolete in a training or rehabilitation regiment and are not useful for advanced users. Current balance boards also do not provide a direct relationship to real-life sporting applications. For example, a surfer or skateboarder will not find a balance board effective for their specific practice and training.

As such, there is a need for a more advanced balance board.

SUMMARY OF THE INVENTION

This invention improves upon existing balance boards by providing a combination of components that increases versatility and challenges with use. The system includes an elongated deck having an upper surface, a lower surface, and opposing ends, and wherein the lower surface of the deck includes a lengthwise recess. In context, "recess" should be taken to include channel, slot, cavity, groove, or the like. A ground-contacting apparatus received by the lengthwise recess facilitates movement of the deck relative to a ground surface, thereby enabling a user to practice balancing on the board while standing on the upper surface of the deck.

The ground-contacting apparatus received by the lengthwise recess is a spherical ball. The lengthwise recess may define a partial cylindrical cross section with a radius of curvature, and the ball may have a radius that matches or is smaller than the radius of the recess. The lengthwise recess may terminate in opposing ends with partial spherical surfaces that define radii corresponding to the radius of the ball. Alternatively, the ground-contacting apparatus may be a cylindrical pin that rolls from end to end as a user maintains their balance while standing on the upper surface of the deck.

As a further alternative, the ground-contacting apparatus received by the lengthwise recess may be an insert having a lower surface with wheels, rollers or non-rotational skateboard trucks. The recess in the lower surface of the deck may define a peripheral outline, and the insert may have a peripheral edge that corresponds to the peripheral outline in the recess. The insert may be held in position within the recess using one or more of hook-and-loop fasteners, magnetic elements, and threaded or other fasteners that extend through the insert and the deck.

In more dedicated embodiments, the lower surface of the insert includes skateboard trucks with rotating or non-rotating wheels, and the opposing ends of the deck may curve upwardly.

DETAILED DESCRIPTION OF THE INVENTION

This invention resides in balance boards and, in particular, versatile balance boards that are more physically challenging than existing devices. In some embodiments, balance boards according to the invention are modular, facilitating customization to particular sports or exercise regimes.

In preferred embodiments, the invention comprises an elongated board or "deck" having upper and lower surfaces, and wherein the lower surface includes a lengthwise groove to receive a separate ground-contacting element. As described in further detail below, the ground-contacting element may be a ball of different sizes, a front-to-back rolling pin, or an insert with rollers or skateboard trucks.

The deck may be constructed of any material capable of withstanding the weight of a heavy adult without breaking. Thus, the deck may be constructed from applicable plastics, various woods, metals such as aluminum, and/or composite materials such as carbon fiber. In preferred embodiments, the deck is of laminated construction, with bonded layers of wood or other materials to increase strength. It is acceptable that the decks flexes somewhat so long as it doesn't break under normal use.

Figure 1:
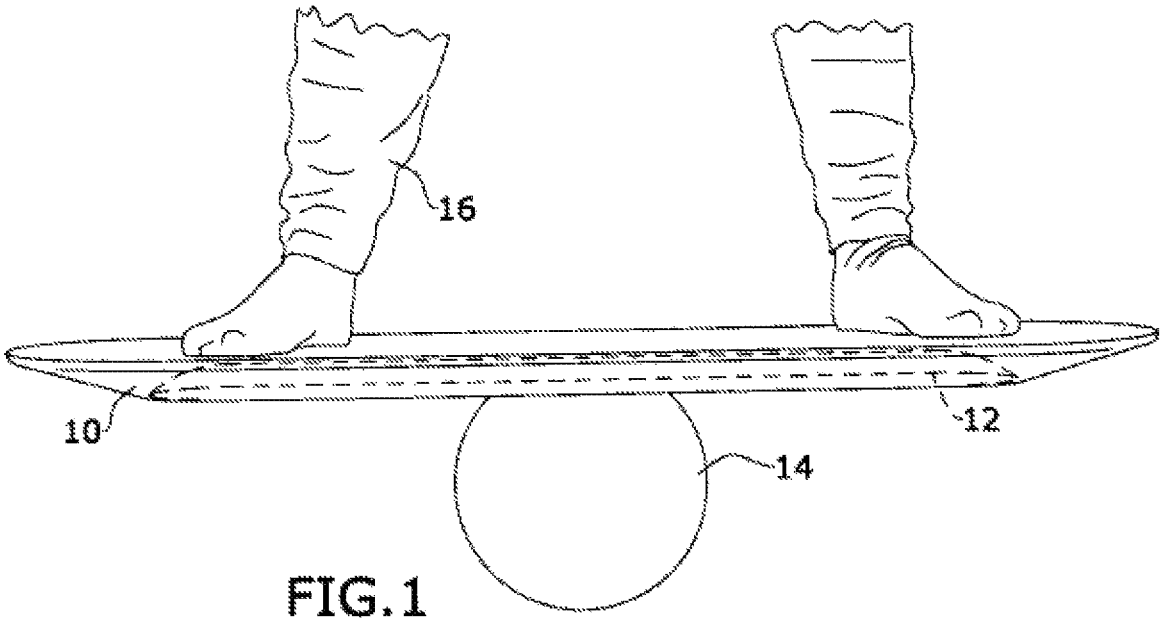
FIG. 1 is a front view of a balance board according to an embodiment of the present invention.

The dimensions of the deck are preferably such that a user 16 may stand with feet separated; for example, as depicted in FIG. 1. Thus, the length of the deck may be in the range of 24 to 36 inches, with the width of the board being on the order of 6 to 24 inches. The thickness of the deck should be in the range of ½ to 3 inches to enable a groove to be formed in the lower surface, whether during molding or machining after fabrication.

The upper surface of the deck 10 may be flat, as shown in FIGS. 1-9, or one or more ends may be contoured. For example, as shown in FIGS. 10-13, the ends of the deck 10 may be curved upwardly in keeping with more traditional skateboard designs. The ends and edges of the deck may be rounded to favor intended use over imbalance situations, and the upper surface may further be textured, or may include "grip tape" to enhance friction.

FIG. 1 is a view of one ball-and-groove embodiment constructed in accordance with the invention. The use of a separate ball 14 increases the difficulty of balancing on the board, while better simulating a board-type sport such as surfing, snowboarding, skateboarding, and a variety of other sports. In this particular embodiment, the groove 12 is in a form or shape of a partial cylinder with spherical ends, and the radius of ball corresponds to the curvature of the walls and ends of the groove. The ball in this case (as well as other components described herein) is preferably constructed of a suitable hard plastic such as polyethylene. The ball may be hollow or solid and, where the radius of the ball matches the curvature of the groove, the radius may be in the range of ½ to 8 inches.

As shown, a portion of the ball is received by the groove, with the lower portion making ground contact. A user stands on the upper surface of the deck while the board is on top of the ball, making it difficult for a user to stand on the board without touching the ground and without assistance. An advanced use of the board may include moving the ball from one end of the board to another without touching the ground and without assistance. Another use of the ball may include rotating an end of the board to the other end without touching the ground and without assistance.

Figure 2:
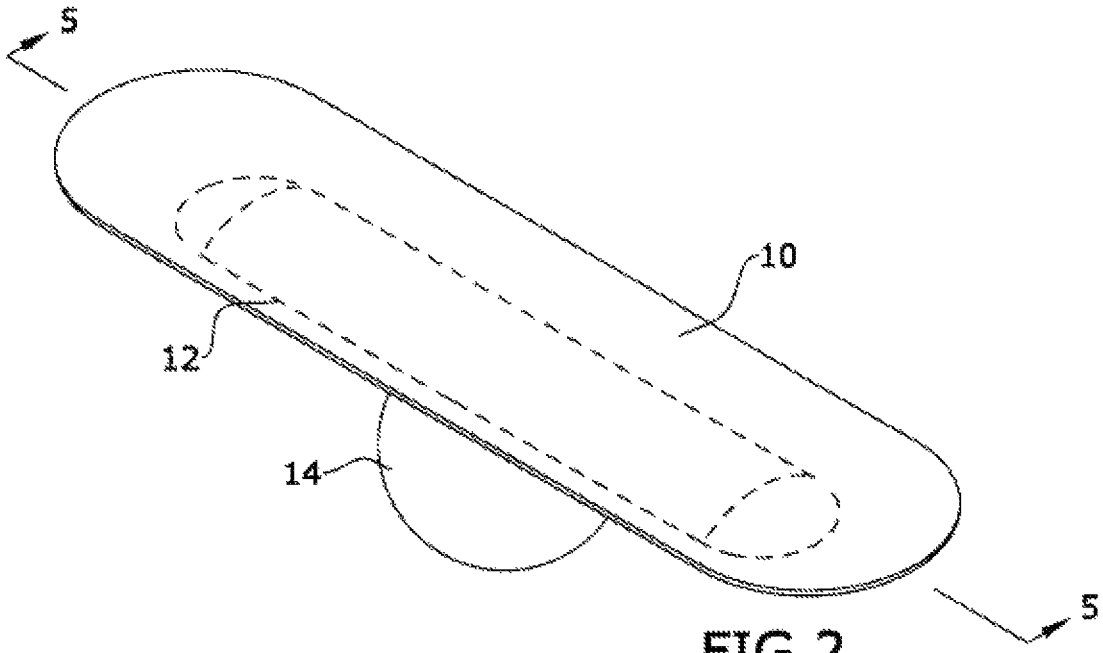
FIG. 2 is a perspective top view thereof.
Figure 3:
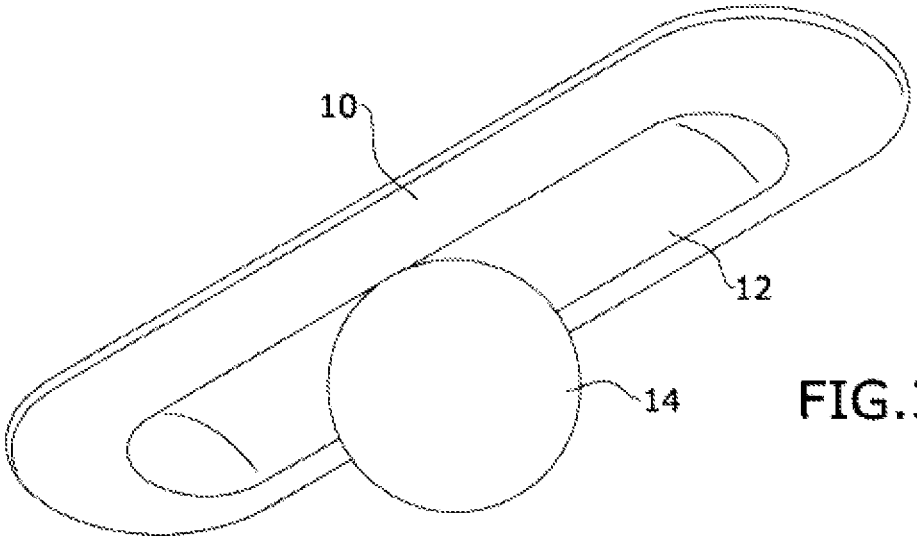
FIG. 3 is a perspective beneath view thereof.
Figure 4:
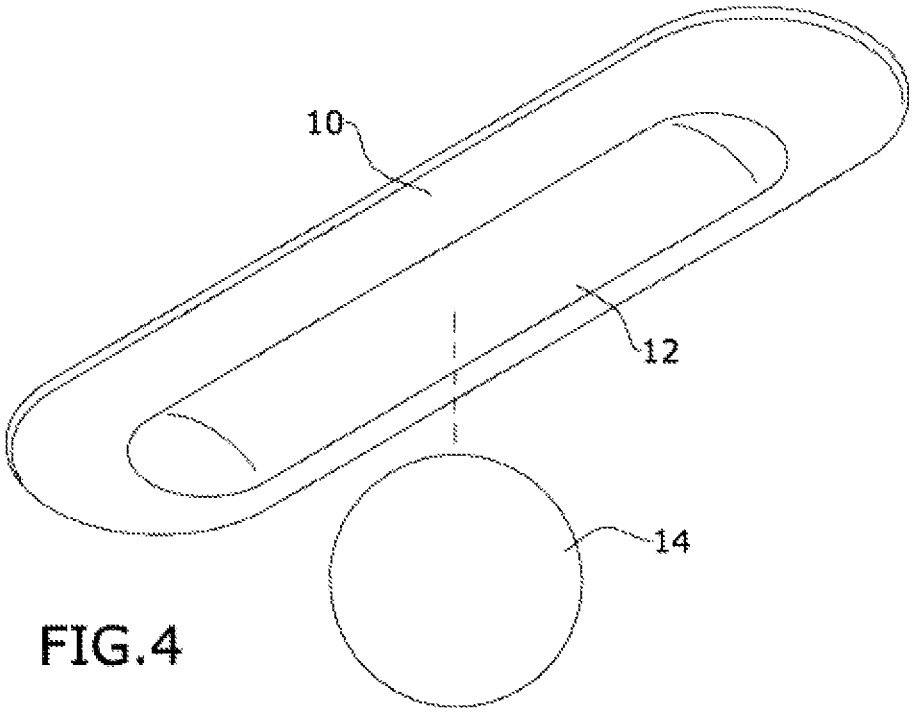
FIG. 4 is a perspective beneath view thereof.
Figure 5:
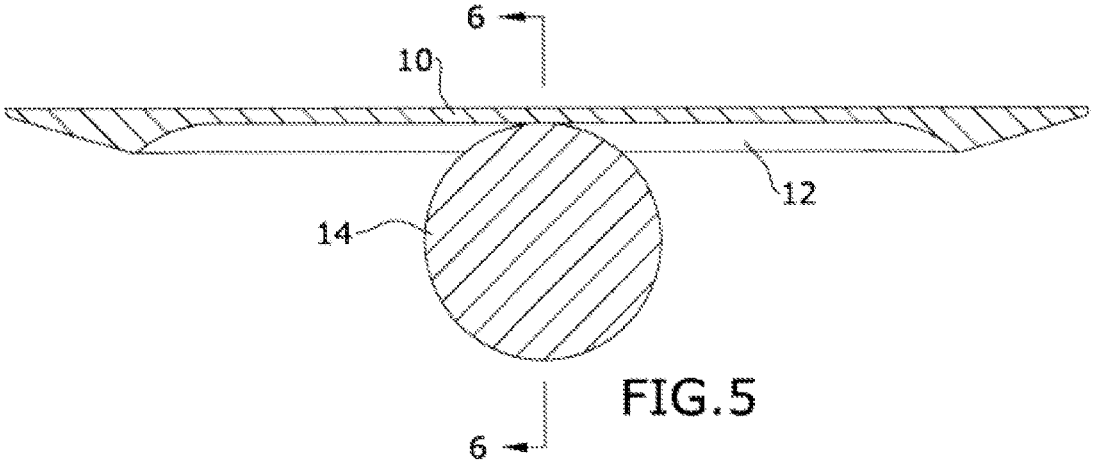
FIG. 5 is a cross sectional view taken along the line 5-5 in FIG. 2.
Figure 6:
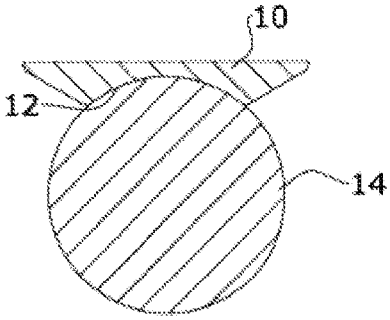
FIG. 6 is a cross sectional view taken along the line 6-6 in FIG. 5.

FIGS. 2 through 4 show different views according to an embodiment of FIG. 1. FIG. 5 is a cross sectional view taken on the line of 5-5 in FIG. 2, and FIG. 6 is a cross sectional view taken on the line of 6-6 in FIG. 5. These views show how the ball 14 fits into the groove 12.

Figure 7:
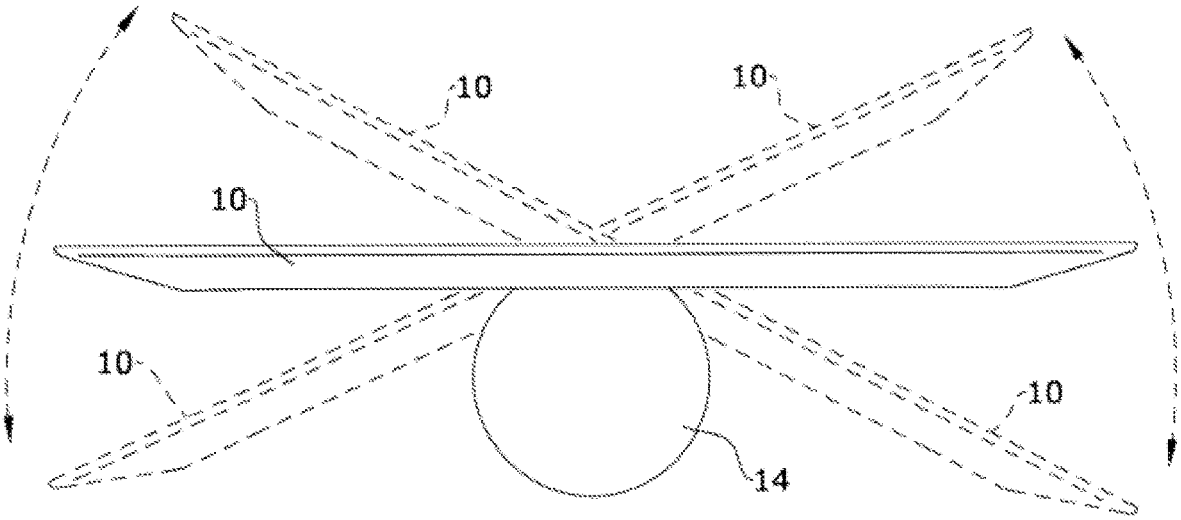
FIG. 7 is a front view showing a movement of the board shown in FIGS. 1-6.
Figure 8:
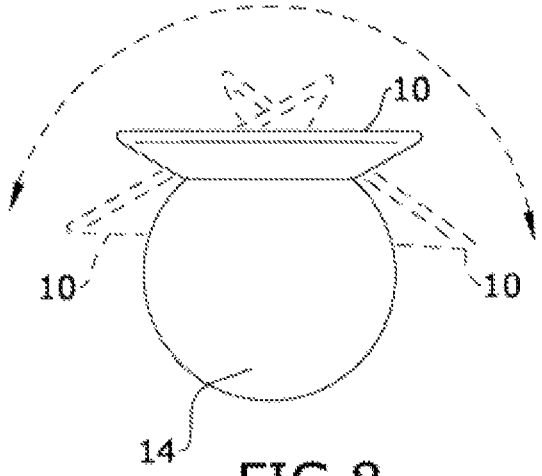
FIG. 8 is a side view showing a movement of the board of the board shown in FIGS. 1-7.
Figure 9:
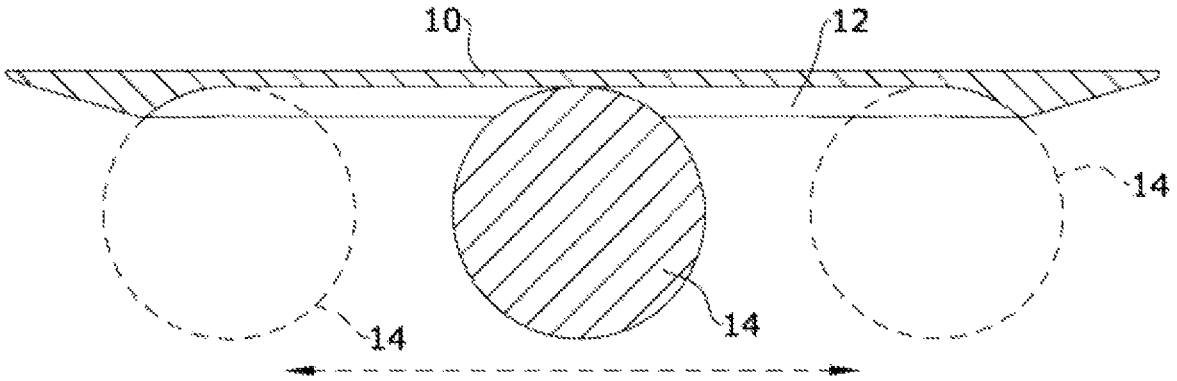
FIG. 9 is a front view showing a movement of the board shown in FIGS. 1-8.

FIGS. 7 through 9 show movements of the board 10 and the ball 14 relative to each other. FIGS. 7 and 8 shows the board 10 tilting at different angles with the ball 14 as a pivot. FIG. 8 shows possible positions and movements of the ball 14 along the groove 12 of the board 10.

Note that while the ball 14 typically rolls in groove 12 without sliding, slipping and sliding of the ball is not precluded by the invention, as both the outer surface of the ball and inner surface of the groove are generally smooth. Thus, depending upon the movements of the user, the ball may roll and/or slide within groove 12.

Figure 10:
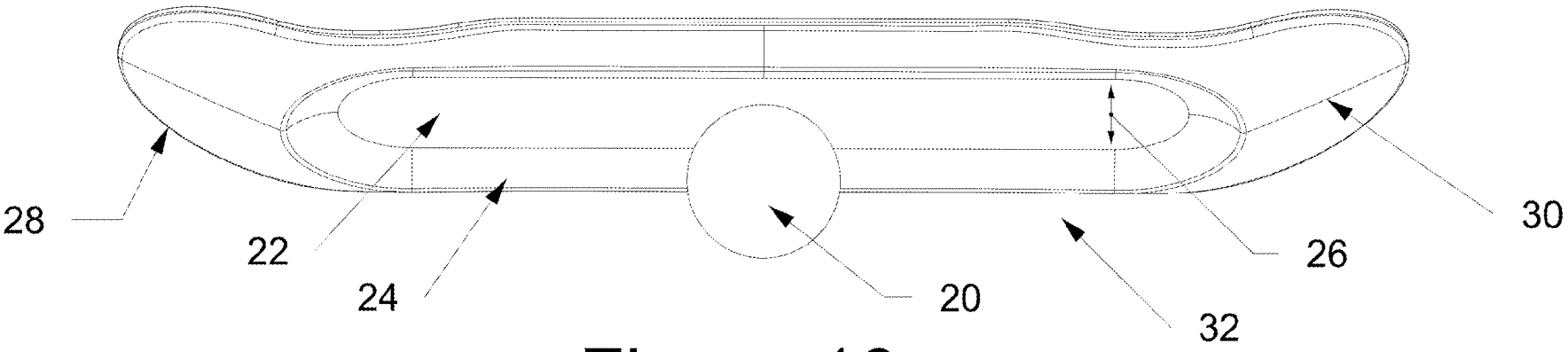
FIG. 10 shows an embodiment of the invention utilizing a smaller ball.

The size of the ball and/or size of the groove may vary to increase or decrease the difficulty of riding the board. Changing the ball and/or groove would change also the rider's experience. FIG. 10, for example, is a bottom side view of an embodiment of the invention using a smaller ball 20 than the one shown in previous figures. In this case the ball may have a diameter in the range of ½ to 8 inches.

The groove 22 may be the same as the one shown in previous figures, in which case the curvature of the sidewall 24 would not match the radius of ball 20. Alternatively, the curvature of the sidewall may correspond to the radius of the radius of a smaller ball, in which case it may be advantageous to provide a flattened area between the inner curvature of the sidewalls 24, enabling the smaller ball to roll from side to side as well as forward and back. As mentioned, the ends 28, 30 of the deck 32 may be configured for a flat or curved upper surface.

Figure 11:
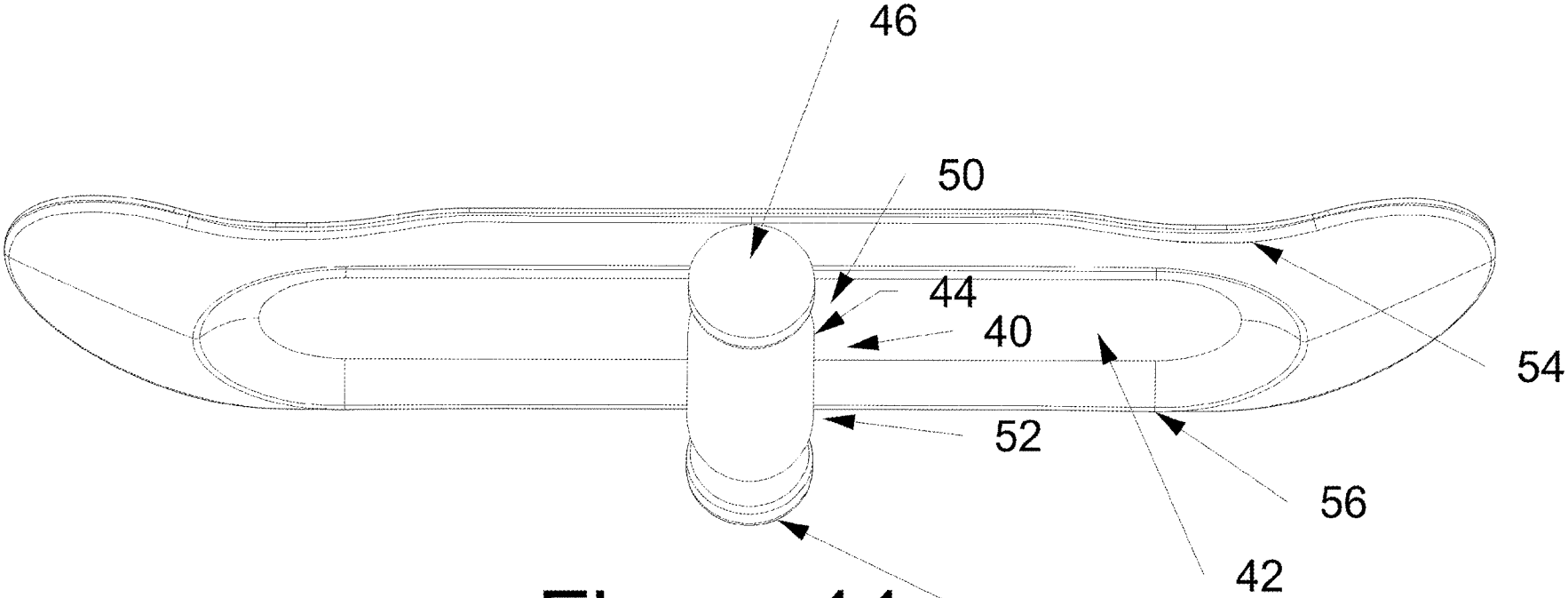
FIG. 11 illustrates an embodiment of the invention utilizing a rolling pin.

FIG. 11 illustrates a further embodiment wherein the ground-contacting element is a pin 40 that moves substantially forward and back as the user shifts their weight on the upper surface of the deck. In this embodiment, groove 42 may be the same as the groove shown in FIG. 10, or it may have a different shape, including the one shown in previous Figures to better correspond to the design of the pin. The pin 40 may have a central, cylindrical section 44 that rides within the groove 42, with opposing bulbous ends 46, 48 with necked-down regions 50, 52 that ride on side edges 54, 56. As with the ground-contact balls, the pin 40 may be made of any suitably durable material such as part plastic or hard rubber. While the pin 40 will largely maintain front-to-back tilting during use, a moderate degree of twisting is also possible depending upon user movement.

In addition to ground-contacting elements such as balls and pins that contact that move or ride on portions of the groove directly, the invention also contemplates the use of inserts received by the groove that provide other types of ground-contacting elements. The inserts disclosed herein may be held in position with and appropriate mechanism, such as hook-and-loop fasteners (not shown), magnets (not shown) or some combination thereof. The insert may have one or more finger holes and/or tabs or loops to assist with removal. As a further alternative, through bolts that extend through the insert and deck may be used.

Figure 12A:
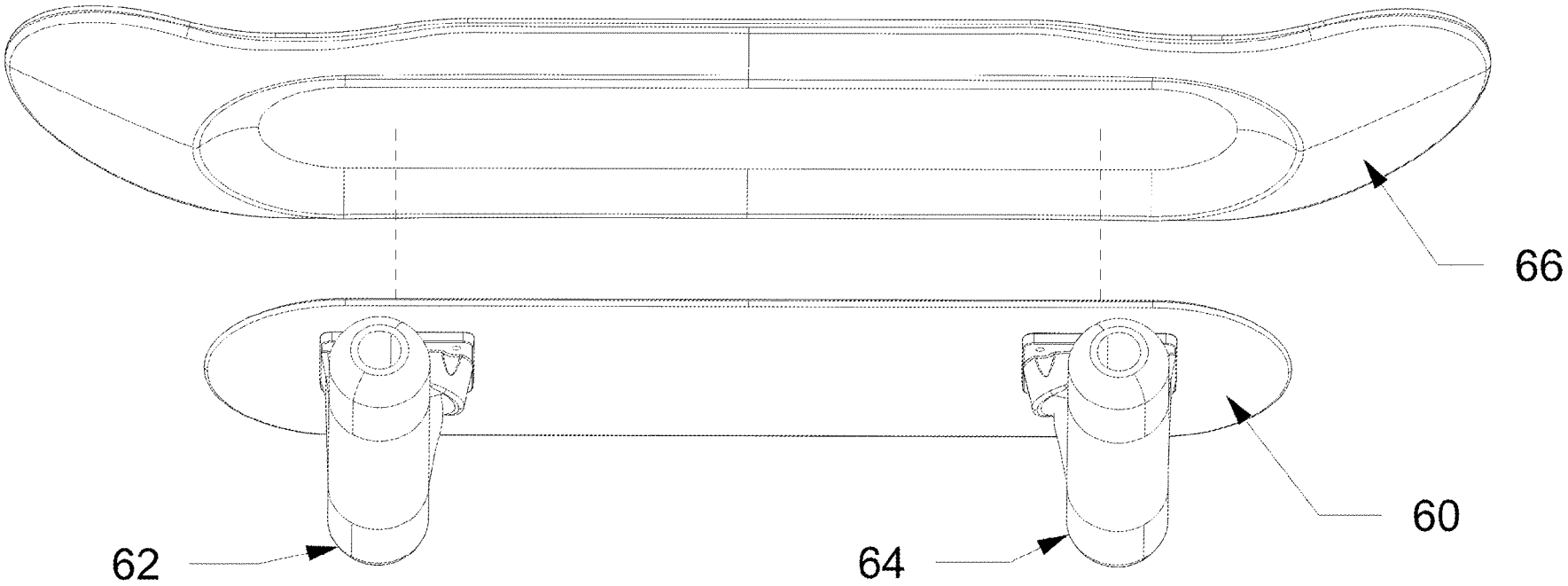
FIG. 12A depicts the installation of an insert with front and back rollers.
Figure 12B:
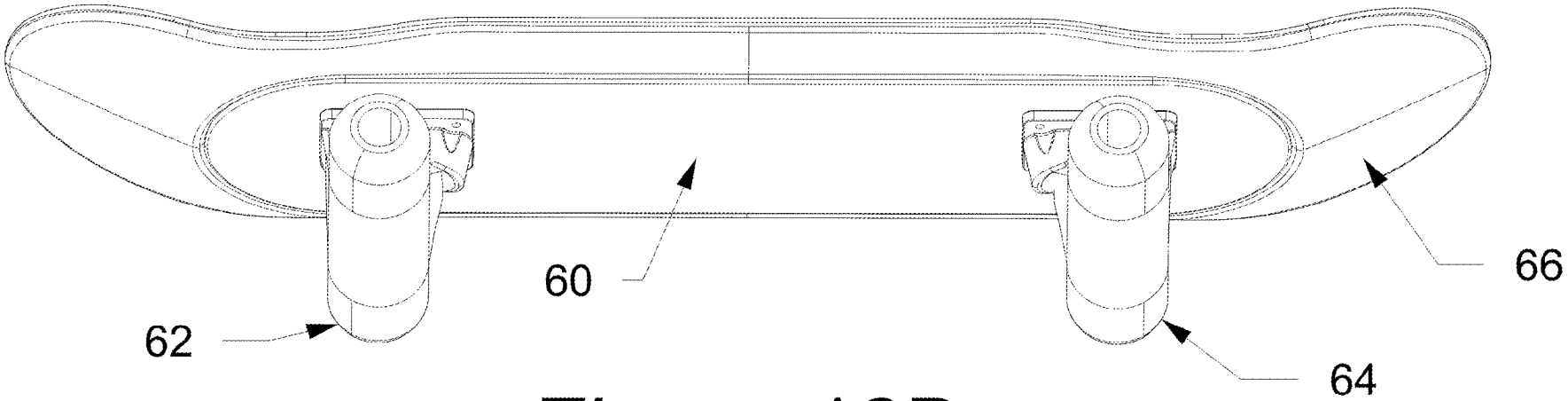
FIG. 12B shows the rollers of FIG. 12A installed.

As a first example, FIG. 12 illustrates an insert 60 that provides front and back stationary rollers 62, 64. FIG. 12A shows the insert 60 being installed in groove 66, and FIG. 12B shows the insert 60 fully installed. Once installed, the rollers 62, 64 may be equidistant to their respective ends, facilitating symmetrical front/back/side usage, or the distances may be different for a different user experience. Like the decks themselves, inserts disclosed herein may be made from any suitable rigid or semi-rigid material such as hard plastic, wood, etc., without or without a laminated construction.

Figure 13A:
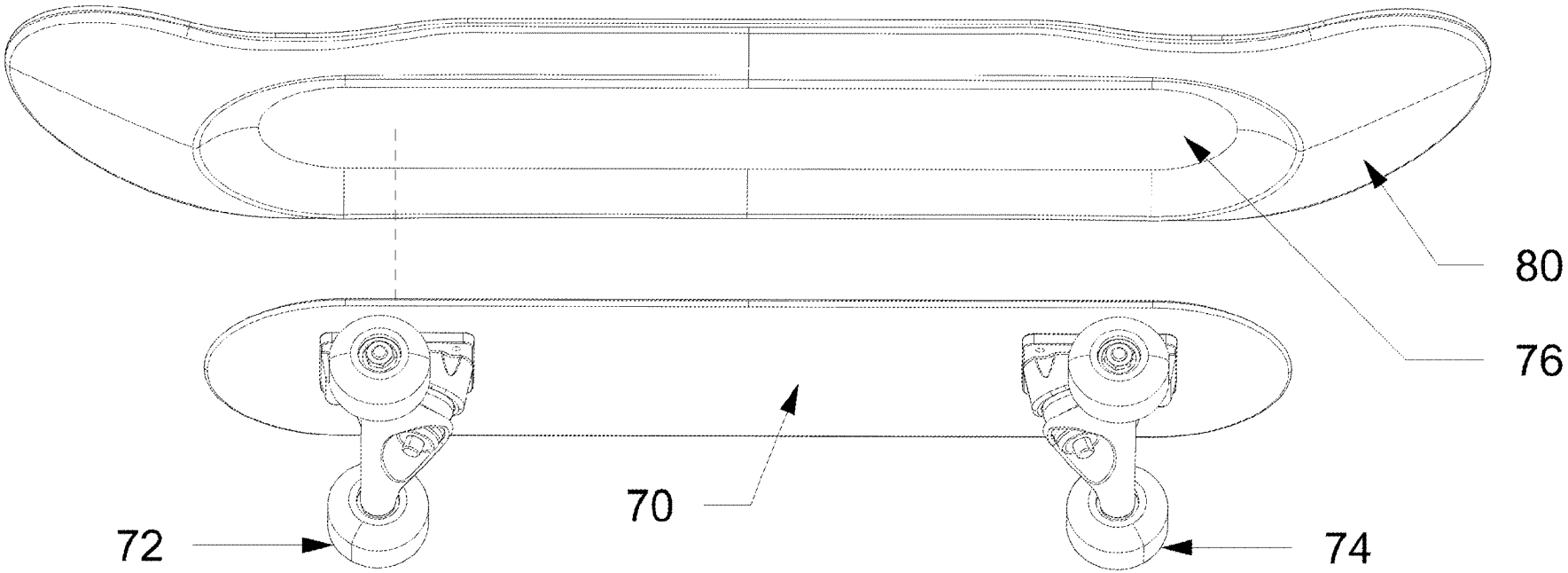
FIG. 13A depicts the installation of an insert with front and back skateboard trucks.
Figure 13B:
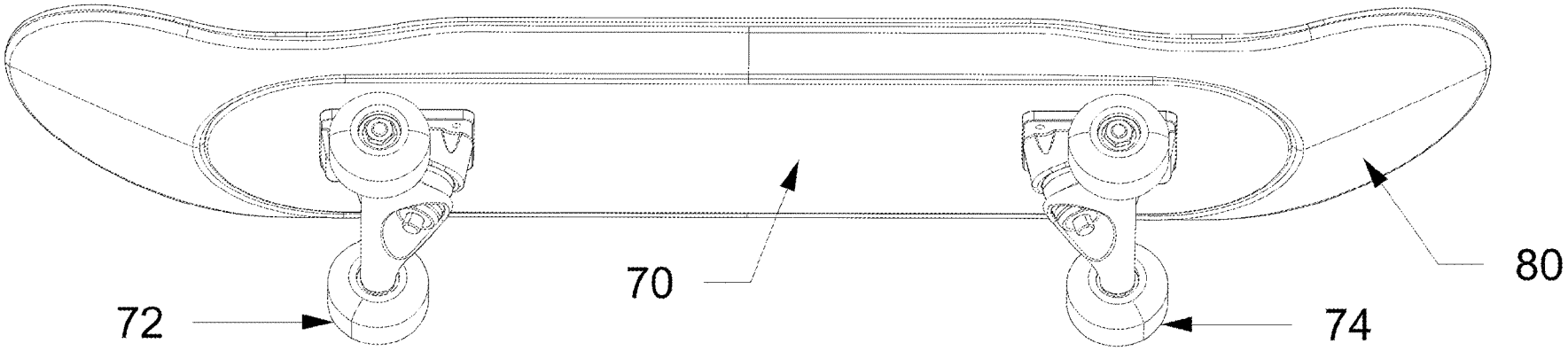
FIG. 13B shows a skateboard embodiment fully assembled.

FIG. 13A depicts yet a different insert-based embodiment of the invention, in this case a panel 70 providing skateboard trucks and wheels 72, 74. FIG. 13A shows the insert 70 being installed in groove 76, and FIG. 13B shows the insert 70 fully installed. The insert may be held in position with and appropriate mechanism, such as hook-and-loop fasteners (not shown), magnets (not shown) or through bolts (not shown). Once installed, the trucks/wheels are preferably equidistant to their respective ends, and the ends of the deck preferably curve upwardly giving the user the fell and performance of a conventional skateboard. But unlike conventional skateboards, the insert 70 may be removed and replaced with a different insert, or a pin or a ball, as the case may be.

Figure 14A:
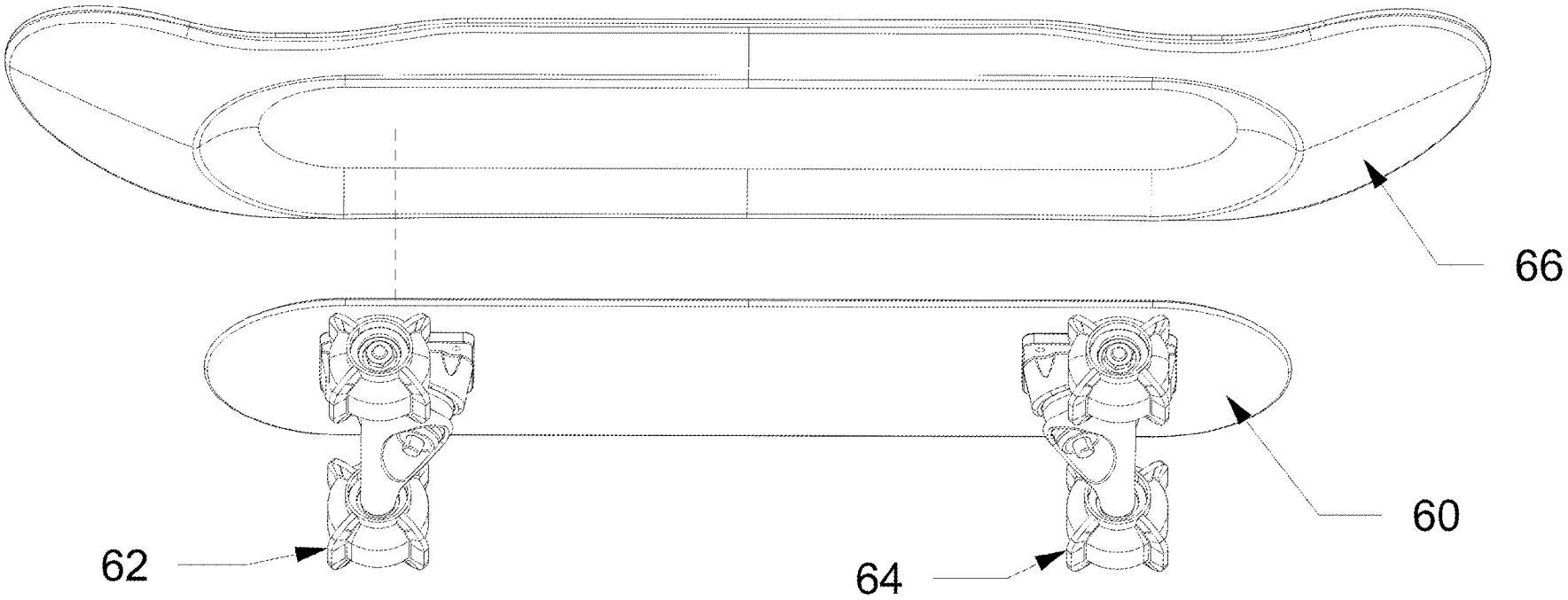
FIG. 14A illustrates an embodiment of the invention with stationary skateboard trucks during installation of the insert.
Figure 14B:
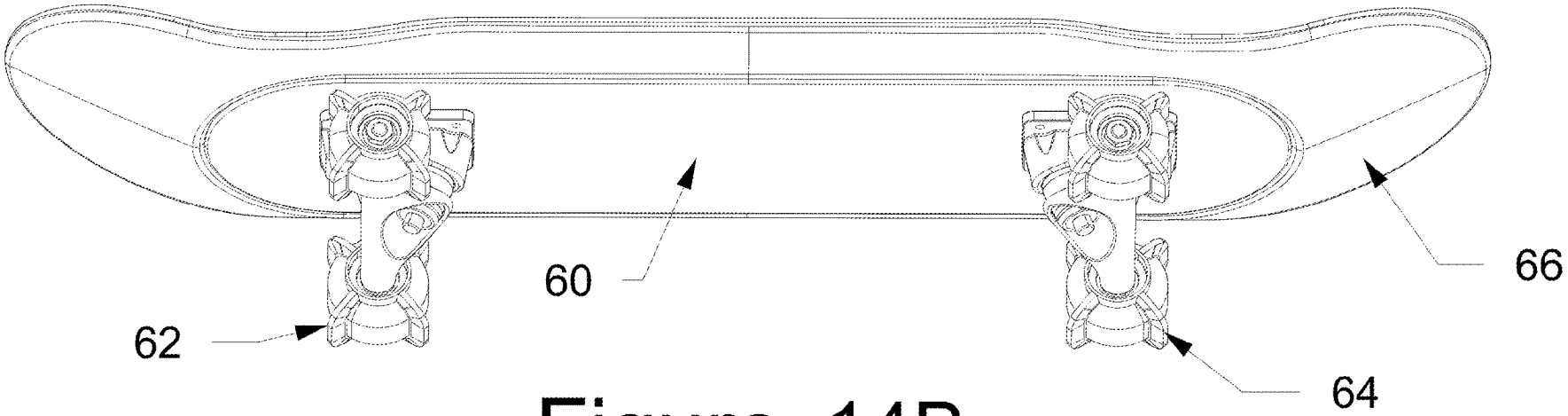
FIG. 14B shows the embodiment of FIG. 14A with the insert installed.

In addition to rolling wheels, there are stationary skateboard trucks that allow the user to practice skateboard tricks without worrying about the wheels rolling. FIG. 14A illustrates such an embodiment of the invention having stationary skateboard trucks during installation of the insert, and FIG. 14B shows the embodiment of FIG. 14A with the insert installed.

The invention claimed is:

1. A balance board, comprising:

an elongated deck having an upper surface, a lower surface, and opposing front and back ends, wherein the lower surface of the elongated deck includes a lengthwise recess; and at least two ground-contacting apparatus interchangeably received by the lengthwise recess facilitating movement of the elongated deck relative to a ground surface, thereby enabling a user to practice balancing on the balance board while standing on the upper surface of the elongated deck, wherein a first one of the ground-contacting apparatus is a spherical ball or cylindrical pin that rolls front-and-back lengthwise within the lengthwise recess as the user maintains their balance while standing on the upper surface of the elongated deck, wherein a second one of the ground-contacting apparatus is a skateboard insert including an elongated panel with a lower surface, front rollers or skateboard trucks mounted the lower surface of the elongated panel, and back rollers or skateboard trucks mounted to the lower surface of the elongated panel, wherein the elongated panel is held in place within the lengthwise recess as the user maintains their balance while standing on the upper surface of the elongated deck, and wherein in use the user can modularly interchange the first ground-contacting apparatus and the second ground-contacting apparatus into the lengthwise recess for different balancing challenges.

2. The balance board of claim 1, wherein the lengthwise recess defines a partial cylindrical cross section with a radius of curvature; and the first ground-contacting apparatus is the spherical ball, wherein the spherical ball has a radius corresponding to the radius of the lengthwise recess.

3. The balance board of claim 2, wherein the lengthwise recess terminates in opposing ends with partial spherical surfaces having radii corresponding to the radius of the spherical ball.

4. The balance board of claim 1, the second ground-contacting apparatus is the skateboard trucks, wherein the skateboard insert further includes front wheels mounted onto the front skateboard trucks and back wheels mounted onto the back skateboard trucks.

5. The balance board of claim 4, wherein the front wheels and the back wheels are non-rotating wheels.

6. The balance board of claim 1, wherein the lengthwise recess defines a partial cylindrical cross section with a radius of curvature; and the first ground-contacting apparatus is the spherical ball, wherein the spherical ball has a radius that is smaller than the radius of the lengthwise recess.

7. The balance board of claim 1, wherein the lengthwise recess in the lower surface of the elongated deck defines a peripheral outline; and the insert panel has a peripheral edge that corresponds to the peripheral outline in the lengthwise recess.

8. The balance board of claim 1, wherein the opposing front and back ends of the elongated deck curve upwardly.

9. The balance board of claim 1, wherein the front and back rollers or skateboard trucks are positioned on the panel so that, with the panel received in the lengthwise recess, the front and back rollers or skateboard trucks are equidistant from the respective opposing front and back ends of the elongated deck.

10. The balance board of claim 1, wherein the front and back rollers or skateboard trucks are mounted onto the same single panel, which is received into the single same lengthwise recess in the elongated deck.

11. The balance board of claim 1, wherein the front and back skateboard trucks are non-rotational skateboard trucks.

12. The balance board of claim 1, wherein the lengthwise recess is defined by and formed into the lower surface of the elongated deck.

13. A balance board, comprising:

an elongated deck having an upper surface, a lower surface, and opposing front and back ends, wherein the lower surface of the elongated deck includes a lengthwise recess;

a cylindrical pin that is receivable by the lengthwise recess facilitating movement of the elongated deck relative to a ground surface, thereby enabling a user to practice balancing on the balance board while standing on the upper surface of the deck, wherein the cylindrical pin rolls front-and-back lengthwise within the lengthwise recess as the user maintains their balance while standing on the upper surface of the elongated deck; and a skateboard insert that is receivable by the lengthwise recess facilitating movement of the elongated deck relative to a ground surface, thereby enabling a user to practice balancing on the balance board while standing on the upper surface of the elongated deck, wherein the skateboard insert includes a single elongated panel with a lower surface, front skateboard trucks mounted to the lower surface of the single elongated panel, and back skateboard trucks mounted to the lower surface of the single elongated panel, wherein the single elongated panel is held in place within the lengthwise recess as the user maintains their balance while standing on the upper surface of the elongated deck, wherein the front and back skateboard trucks are mounted onto the single elongated panel, which is received into the lengthwise recess in the elongated deck, wherein in use the user can interchange the cylindrical pin and the skateboard insert into the lengthwise recess for different balancing challenges.

14. The balance board of claim 13, wherein the lengthwise recess in the lower surface of the elongated deck defines a peripheral outline, and the insert panel has a peripheral edge that corresponds to the peripheral outline in the lengthwise recess.

15. The balance board of claim 13, wherein the front and back skateboard trucks are positioned on the panel so that, with the panel received in the lengthwise recess, the front and back skateboard trucks are equidistant from the respective opposing front and back ends of the elongated deck.

16. The balance board of claim 13, wherein the skateboard insert further includes front wheels mounted onto the front skateboard trucks and back wheels mounted onto the back skateboard trucks.

17. The balance board of claim 13, wherein the lengthwise recess is defined by and formed into the lower surface of the elongated deck.

* * * * *